US010285440B2

(12) United States Patent
Martini

(10) Patent No.: US 10,285,440 B2
(45) Date of Patent: May 14, 2019

(54) WRAPPING POUCH FOR A SMOKING PIPE

(71) Applicant: Chase C. Martini, Escondido, CA (US)

(72) Inventor: Chase C. Martini, Escondido, CA (US)

( * ) Notice: Subject to any disclaimer, the term of this patent is extended or adjusted under 35 U.S.C. 154(b) by 120 days.

(21) Appl. No.: 14/673,702

(22) Filed: Mar. 30, 2015

(65) Prior Publication Data

US 2015/0272213 A1 Oct. 1, 2015

Related U.S. Application Data

(60) Provisional application No. 61/971,961, filed on Mar. 28, 2014.

(51) Int. Cl.
*A45C 1/00* (2006.01)
*A24F 23/02* (2006.01)

(52) U.S. Cl.
CPC ..... *A24F 23/02* (2013.01)

(58) Field of Classification Search
USPC ..... 206/242, 244, 236; 224/901.2, 250, 601, 224/602, 603, 219, 223
See application file for complete search history.

(56) References Cited

U.S. PATENT DOCUMENTS 2,075,629 A * 3/1937 Singer ..... A24F 23/04 206/236
2,161,854 A * 6/1939 Copell ..... G09F 5/042 131/260
2,784,887 A * 3/1957 Habler ..... A24F 9/14 131/260
4,069,954 A * 1/1978 Rauch ..... A45F 5/00 224/219
4,881,684 A * 11/1989 Chinman ..... A45C 3/00 190/115
4,917,280 A * 4/1990 Schneider ..... A41F 9/002 224/223
4,967,986 A * 11/1990 Schildkraut ..... A45C 3/10 224/223
6,041,921 A * 3/2000 Staiano ..... A24F 23/04 206/236
6,065,659 A * 5/2000 Faz ..... A45C 11/26 206/570
6,578,707 B2 * 6/2003 Staiano ..... A24F 23/04 206/236
8,915,365 B2 * 12/2014 Fath ..... B65D 77/0426 206/242
2003/0231810 A1 * 12/2003 Durney ..... B65D 33/01 383/74

(Continued)

*Primary Examiner* — Jacob K Ackun

(57) ABSTRACT

A wrapping pouch for a smoking pipe is a device for securely storing smoking paraphernalia on a smoking pipe. The device features a flexible fabric strap that may be wrapped around the smoking pipe as well as at least one accessory pocket for storing various paraphernalia such as lighters, tobacco, and medical marijuana. Once the flexible fabric strap has been wrapped around the smoking pipe, a hook-and-loop fastener is able to hold the flexible fabric strap in place. The at least one accessory pocket may be opened or closed via an at least one cord sheathe, an at least one elastic cord, and an at least one cord clamp. Additionally, the device features an inner grip layer that prevents the flexible fabric strap from sliding on the smoking pipe. The device may additionally feature a plurality of aesthetic covers to improve the aesthetic appeal of the device.

6 Claims, 15 Drawing Sheets

(56) References Cited

U.S. PATENT DOCUMENTS

| | | | | |
|---|---|---|---|---|
| 2004/0114836 | A1* | 6/2004 | LeClaire | A45C 1/10<br>383/93 |
| 2005/0040194 | A1* | 2/2005 | Frye | A45D 29/20<br>224/219 |
| 2006/0261108 | A1* | 11/2006 | Watts, Sr. | A45C 1/04<br>224/222 |
| 2007/0108240 | A1* | 5/2007 | Berger | A41D 15/00<br>224/153 |
| 2008/0011794 | A1* | 1/2008 | Daniel | A45F 5/02<br>224/183 |

* cited by examiner

WRAPPING POUCH FOR A SMOKING PIPE

The current application claims a priority to the U.S. Provisional Patent application Ser. No. 61/971,961 filed on Mar. 28, 2014. The current application is filed on Mar. 30, 2015 while Mar. 28, 2015 was on a weekend.

FIELD OF THE INVENTION

The present invention relates generally to a pouch for holding smoking paraphernalia. More specifically, the present invention is a wrapping pouch that may be wrapped around a smoking pipe for holding smoking paraphernalia such as a lighter, tobacco, and medical marijuana.

BACKGROUND OF THE INVENTION

Misplaced paraphernalia can be a common annoyance for smokers as a missing accessory such as a lighter can prevent the smoker from smoking altogether. As such, it is common to store paraphernalia in a separate bag or pouch for convenient access and to prevent losing the paraphernalia. However, ultimately, a bag or pouch may cause the same problems that the bag or pouch was originally intended to resolve as it is possible to misplace the bag or pouch as well. This can be particularly problematic, particularly if, for example, one requires medical marijuana in order to alleviate epileptic seizures that may occur at unpredictable times. The present invention seeks to address the aforementioned issues as well as provide the user with a convenient and practical solution.

The present invention is a wrapping pouch for a smoking pipe that holds smoking paraphernalia. The present invention may be wrapped around and secured to the smoking pipe. The present invention may be easily removed from the smoking pipe as needed such as when the user is washing the smoking pipe. The present invention allows various types of smoking paraphernalia to be stored along with the smoking pipe, allowing the user to easily and conveniently access the paraphernalia as needed. The present invention is able to reduce the likelihood of misplacing smoking paraphernalia as well. In addition to storing smoking paraphernalia in a single accessible location, the present invention provides aesthetic appeal to the smoking pipe and may be customized to the user's preferences.

DETAIL DESCRIPTIONS OF THE INVENTION

Figure 1:
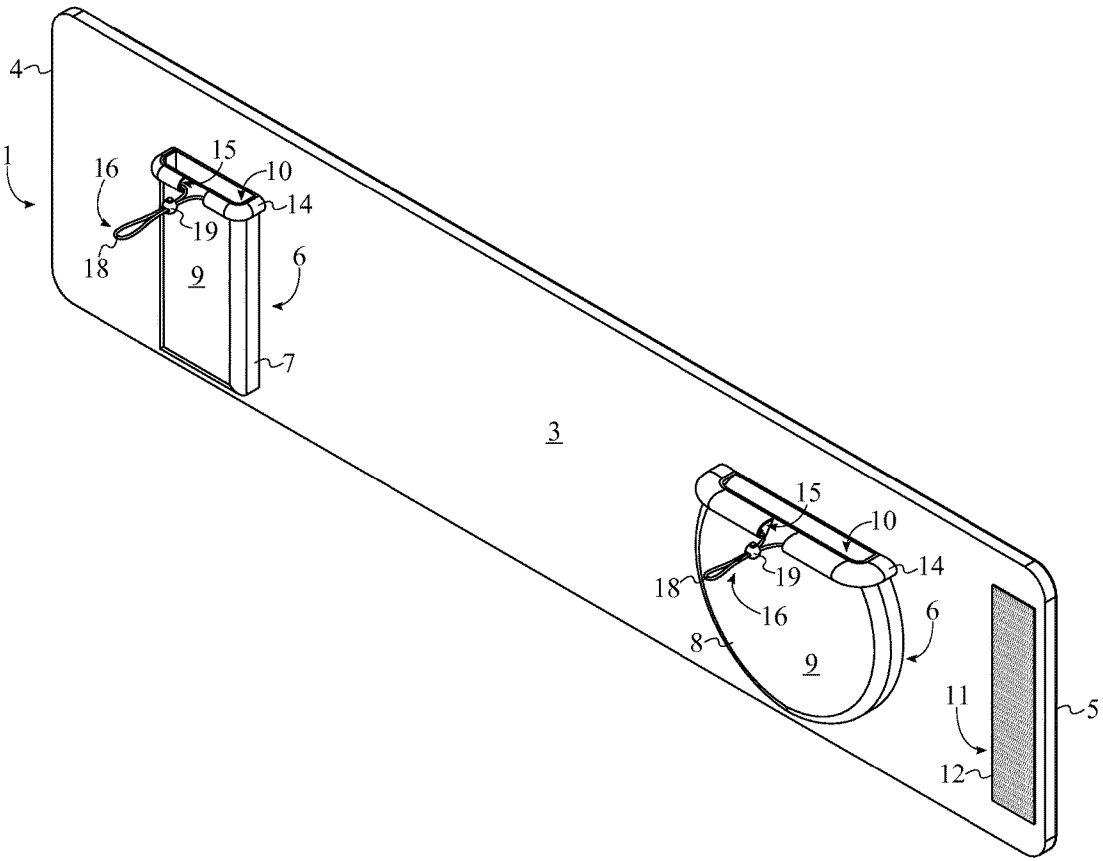
FIG. 1 is a front perspective view of the present invention.

All illustrations of the drawings are for the purpose of describing selected versions of the present invention and are not intended to limit the scope of the present invention.

The present invention is a wrapping pouch for a smoking pipe that holds smoking paraphernalia in an easily accessible and convenient manner. The present invention is shown in FIGS. 1-8 and comprises a flexible fabric strap 1, an at least one accessory pocket 6, and a hook-and-loop fastener 11.

The flexible fabric strap 1 is wrapped around the smoking pipe and serves as a base for the at least one accessory pocket 6. The flexible fabric strap 1 comprises an inner surface 2, an outer surface 3, a first end 4, and a second end 5. The inner surface 2 is the surface that is oriented toward the smoking pipe when the present invention is attached to the smoking pipe. The outer surface 3 is the surface that is oriented away from the smoking pipe. The first end 4 and the second end 5 may be joined together via the hook-and-loop fastener 11 in order to secure the flexible fabric strap 1 in place on the smoking pipe. The first end 4 and the second end 5 are positioned opposite to each other along the flexible fabric strap 1. This allows the first end 4 to be affixed to the second end 5 via the hook-and-loop fastener 11 after the flexible fabric strap 1 has been wrapped around the smoking pipe.

Figure 8:
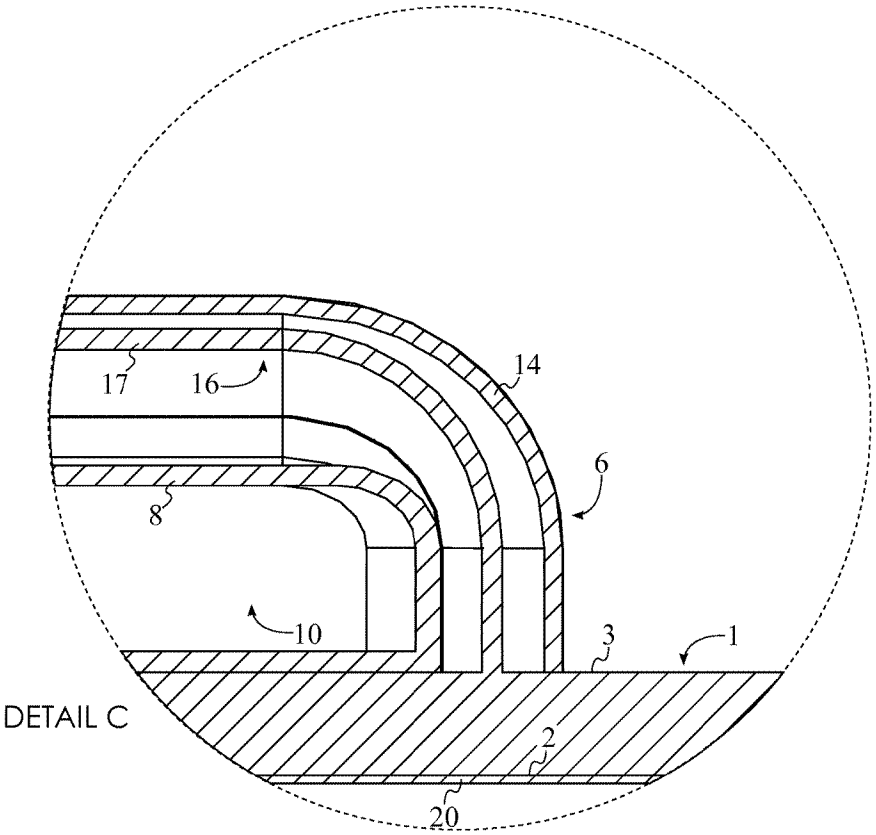
FIG. 8 is a detail view of the present invention taken from circle C of FIG. 7.
Figure 9:
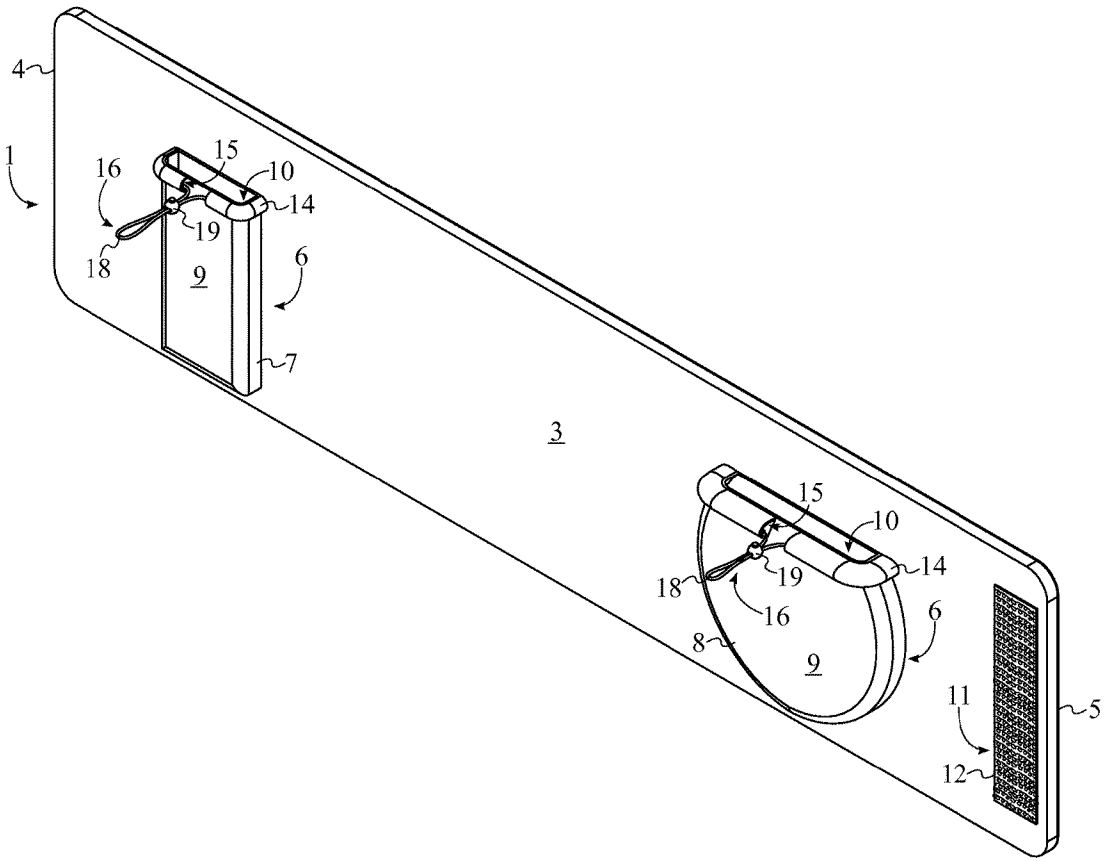
FIG. 9 is a front perspective view of an alternative embodiment of the present invention, wherein the alternative embodiment features a first interlocking strip as a loop fastener and a second interlocking strip as a hook fastener.
Figure 10:
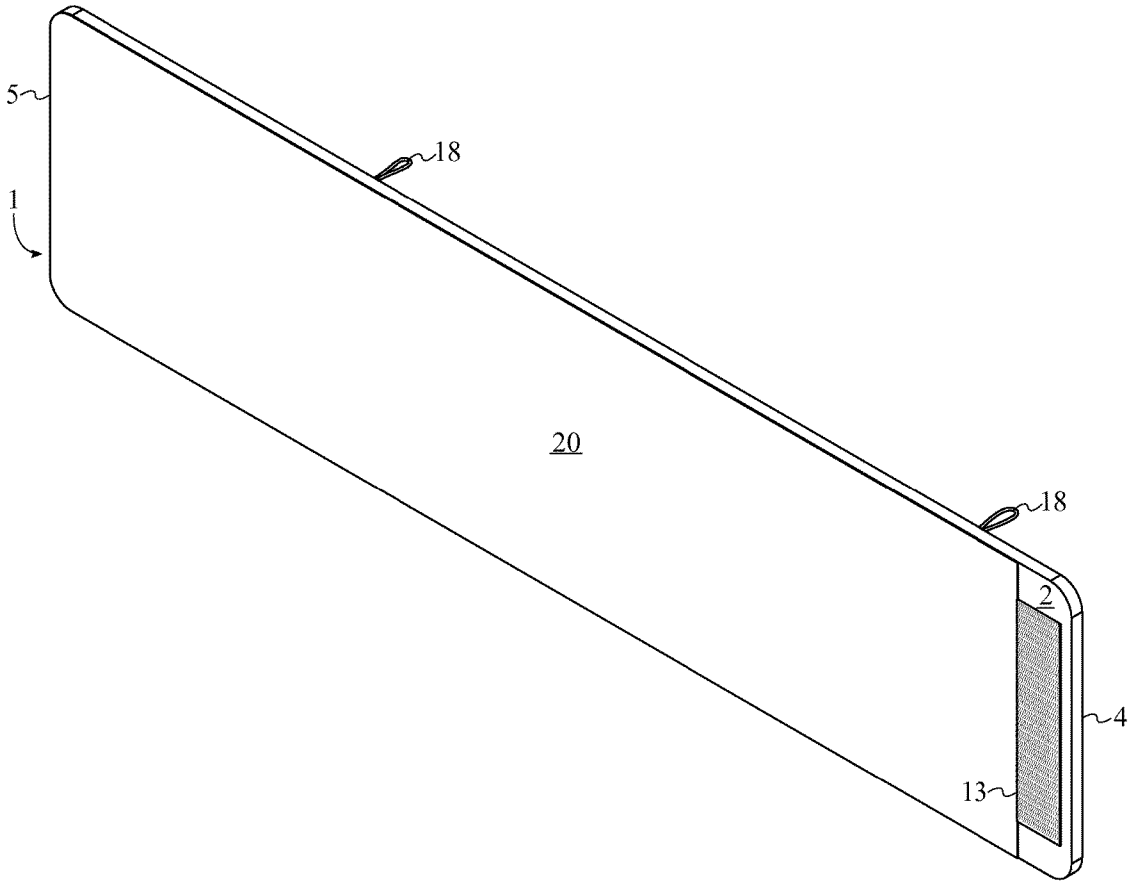
FIG. 10 is a rear perspective view of the alternative embodiment of the present invention.

The hook-and-loop fastener 11 serves to secure the flexible fabric strap 1 in place on the smoking pipe and prevents the flexible fabric strap 1 from separating from the smoking pipe. The hook-and-loop fastener 11 comprises a first interlocking strip 12 and a second interlocking strip 13. In the preferred embodiment of the present invention shown in FIGS. 1-8, the first interlocking strip 12 is a hook portion of the hook-and-loop fastener 11 and the second interlocking strip 13 is a loop portion of the hook-and-loop fastener 11. An alternative embodiment of the present invention is shown in FIG. 9 and FIG. 10 in which the first interlocking strip 12 is a loop portion of the hook-and-loop fastener 11 and the second interlocking strip 13 is a hook portion of the hook-and-loop fastener 11. The first interlocking strip 12 is removably engaged to the second interlocking strip 13, allowing the user to secure the flexible fabric strap 1 to the smoking pipe while allowing the user to easily remove the flexible fabric strap 1 from the smoking pipe as well. The first interlocking strip 12 is connected onto the outer surface 3, adjacent to the second end 5 while the second interlocking strip 13 is connected onto the inner surface 2, adjacent to the first end 4. As such, the first interlocking strip 12 and the second interlocking strip 13 may be engaged to each other which allows the outer surface 3 to be oriented outward from the smoking pipe.

The at least one accessory pocket 6 is able to hold a variety of smoking paraphernalia on the flexible fabric strap 1 when attached to the smoking pipe. In the preferred embodiment of the present invention, the at least one accessory pocket 6 is connected onto the outer surface 3. As such, the at least one accessory pocket 6 is placed into a convenient and accessible position on the flexible fabric strap 1 when the flexible fabric strap 1 is attached to the smoking pipe.

In the preferred embodiment of the present invention, the at least one accessory pocket 6 comprises a first accessory pocket 7 and a second accessory pocket 8. The first accessory pocket 7 and the second accessory pocket 8 may be utilized to hold smoking paraphernalia such as, but not limited to, lighters, tobacco, and medical marijuana. The first accessory pocket 7 is positioned in between the first interlocking strip 12 and the second interlocking strip 13, adjacent to the first end 4. The second accessory pocket 8 is positioned in between the first accessory pocket 7 and the first interlocking strip 12. The positioning of the first accessory pocket 7 and the second accessory pocket 8 prevents the first accessory pocket 7 and the second accessory pocket 8 from interfering with the first interlocking strip 12 and the second interlocking strip 13 when wrapping and securing the flexible fabric strap 1 in place on the smoking pipe.

The present invention further comprises an at least one cord sheathe 14. The at least one cord sheathe 14 is utilized to close the at least one accessory pocket 6 and prevent paraphernalia within the at least one accessory pocket 6 from falling out of the at least one accessory pocket 6. The at least one accessory pocket 6 comprises a lateral portion 9 and an open end 10. The lateral portion 9 is the portion of the at least one accessory pocket 6 that serves as a sidewall for the at least one accessory pocket 6 and holds the paraphernalia in place. Paraphernalia may be placed into or taken out of the at least one accessory pocket 6 via the open end 10. The at least one cord sheathe 14 is externally connected along the lateral portion 9, adjacent to the open end 10. This allows the at least one cord sheathe 14 to be drawn against and close the open end 10 in order to prevent paraphernalia from falling out of the at least one accessory pocket 6.

An embodiment of the present invention further comprises an at least one elastic cord 16 and an at least one cord clamp 19. The at least one elastic cord 16 and the at least one cord clamp 19 serve to close the open end 10 in conjunction with the at least one cord sheathe 14. The at least one cord sheathe 14 comprises a cord opening 15 that provides grasping access to the at least one elastic cord 16. The at least one elastic cord 16 may be tightened or loosened in order to close or open the open end 10, respectively. The at least one cord clamp 19 is able to secure the at least one elastic cord 16 with the open end 10 in either a closed or open configuration. The at least one elastic cord 16 comprises a tensioning portion 17 and a free portion 18. The tensioning portion 17 is the portion of the at least one elastic cord 16 that is tightened or loosened when the open end 10 is closed or opened, respectively. The free portion 18 is the portion of the at least one elastic cord 16 that is grasped by the user when tightening or loosening the tensioning portion 17. The tensioning portion 17 traverses through the at least one cord sheathe 14 as shown in FIG. 8. As such, when the tensioning portion 17 is tightened, the open end 10 is drawn closed by the at least one elastic cord 16 and the at least one cord sheathe 14. When the tensioning portion 17 is loosened, the open end 10 is correspondingly able to open due to the relaxation of the at least one elastic cord 16 and the at least one cord sheathe 14. The cord opening 15 laterally traverses into the at least one cord sheathe 14. Additionally, the free portion 18 traverses out of the at least one cord sheathe 14 from the cord opening 15, allowing the user to access and grasp the free portion 18 on the exterior of the at least one cord sheathe 14 when tightening or loosening the tensioning portion 17. The at least one cord clamp 19 is slidably engaged along the free portion 18, allowing the user to adjust the position of the at least one cord clamp 19 after tightening or loosening the tensioning portion 17.

Figure 11:
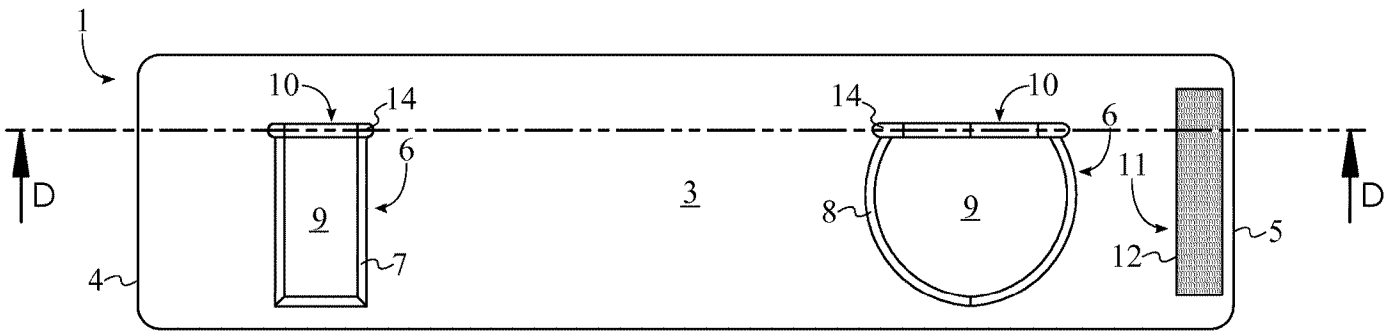
FIG. 11 is a front view of the present invention with an at least one elastic cord traversing through an at least one cord sheathe.
Figure 12:
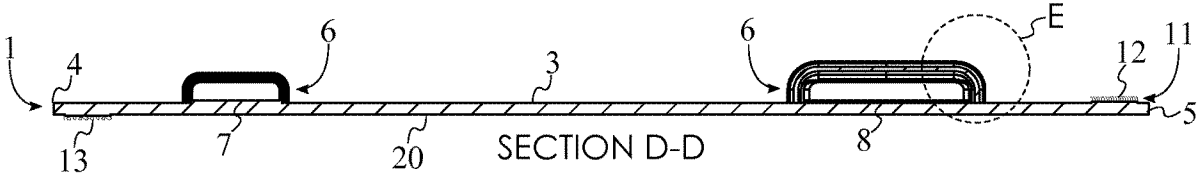
FIG. 12 is a cross-sectional view of the present invention with the at least one elastic cord traversing through the at least one cord sheathe taken along line D-D of FIG. 11.
Figure 13:
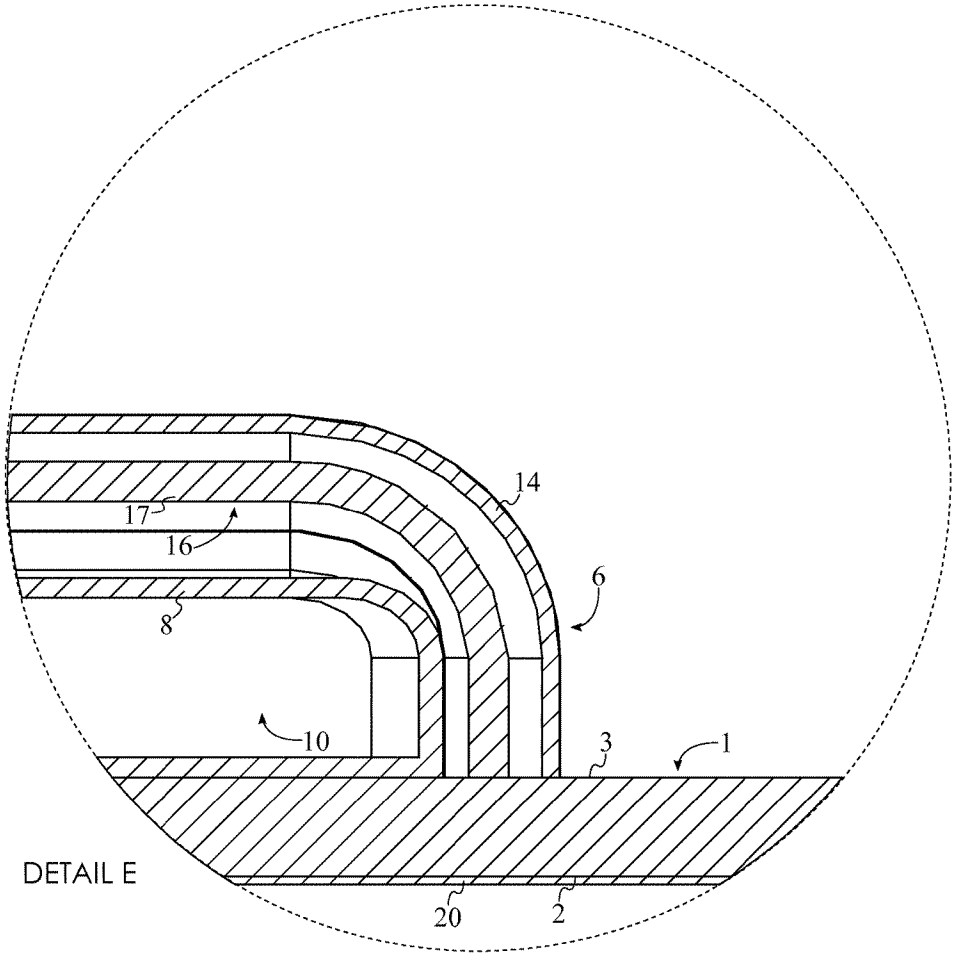
FIG. 13 is a detail view of the present invention with the at least one elastic cord traversing through the at least one cord sheathe taken from circle E of FIG. 12.

In the additional embodiment of the present invention shown in FIGS. 11-13, the at least one elastic cord 16 traverses through the at least one cord sheathe 14. In this embodiment of the present invention, the at least one elastic cord 16 remains taut in order to close the open end 10. The user may grasp and open the open end 10 in order to place paraphernalia into or remove paraphernalia from the at least one accessory pocket 6.

Figure 2:
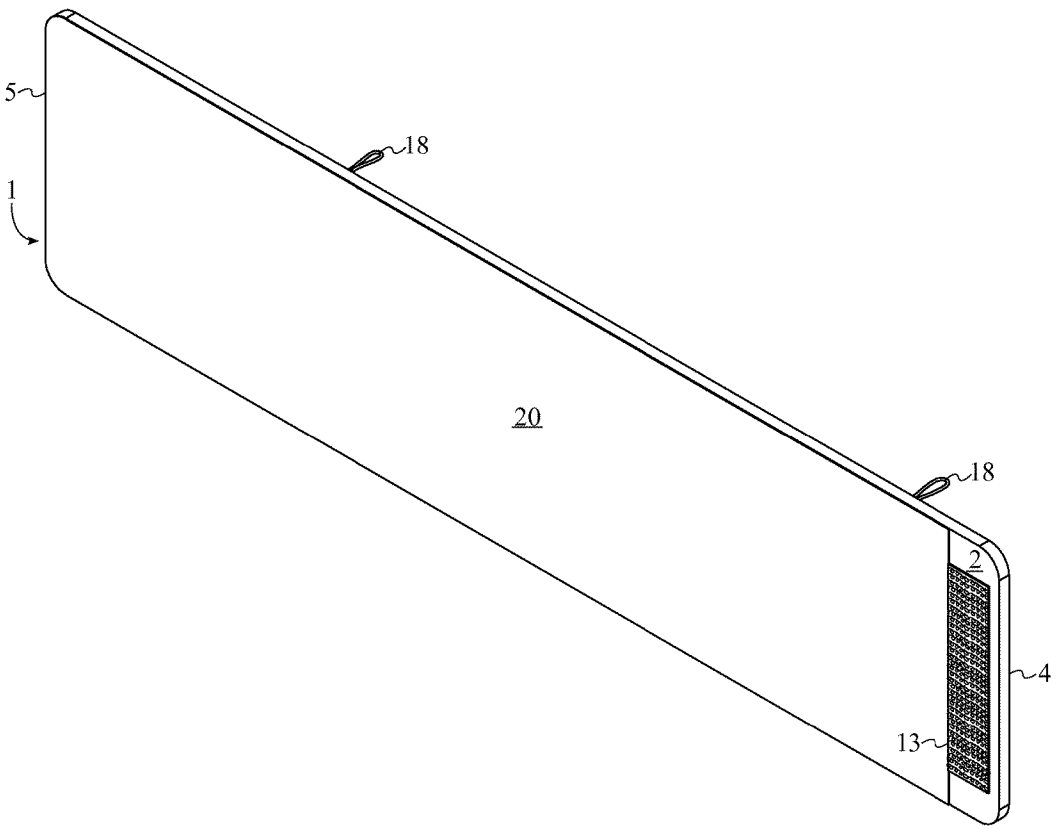
FIG. 2 is a rear perspective view of the present invention.
Figure 3:
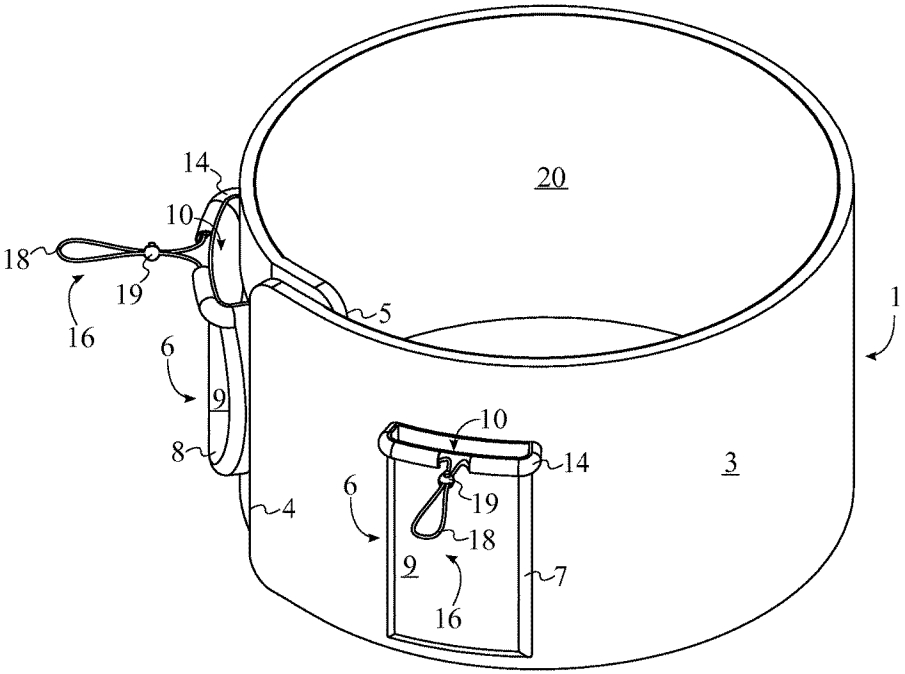
FIG. 3 is a front perspective view of the present invention in a wrapped configuration.
Figure 4:
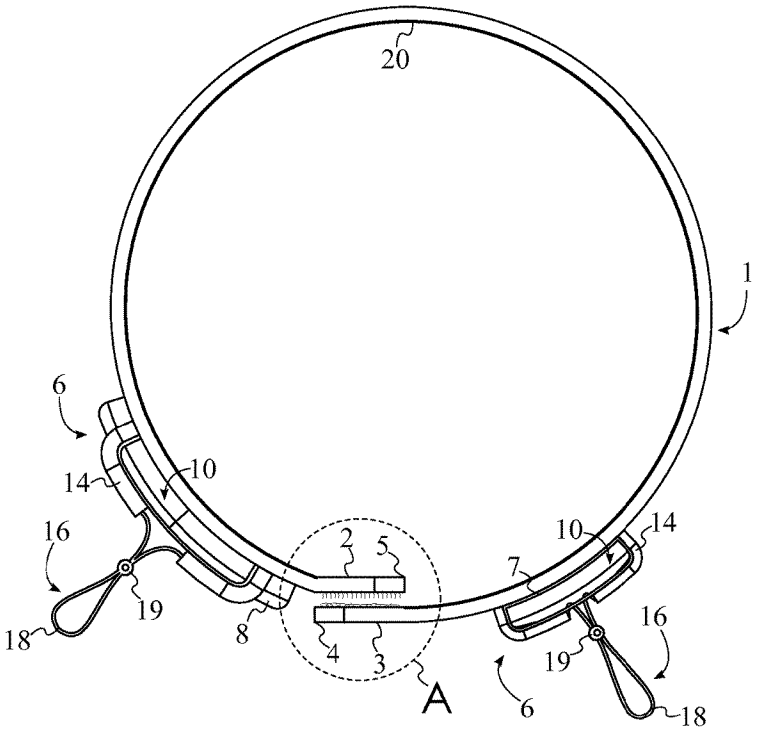
FIG. 4 is a top view of the present invention in a wrapped configuration.
Figure 5:
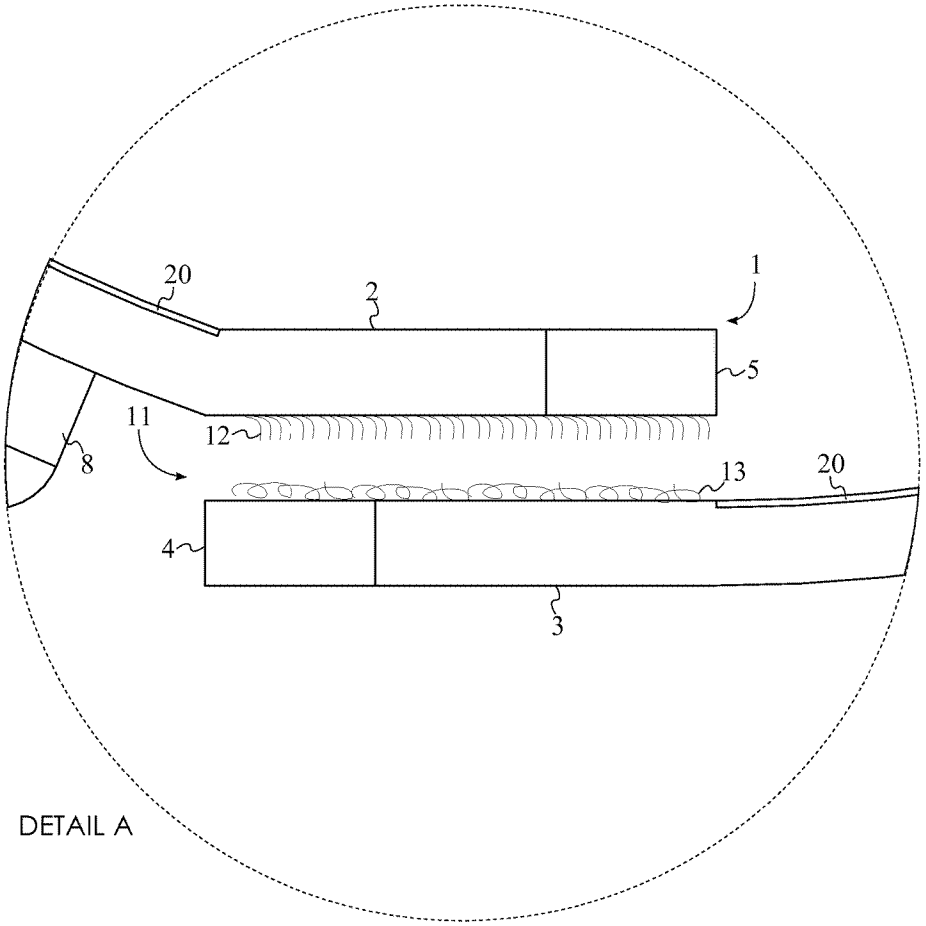
FIG. 5 is a detail view of the present invention taken from circle A of FIG. 4.
Figure 6:
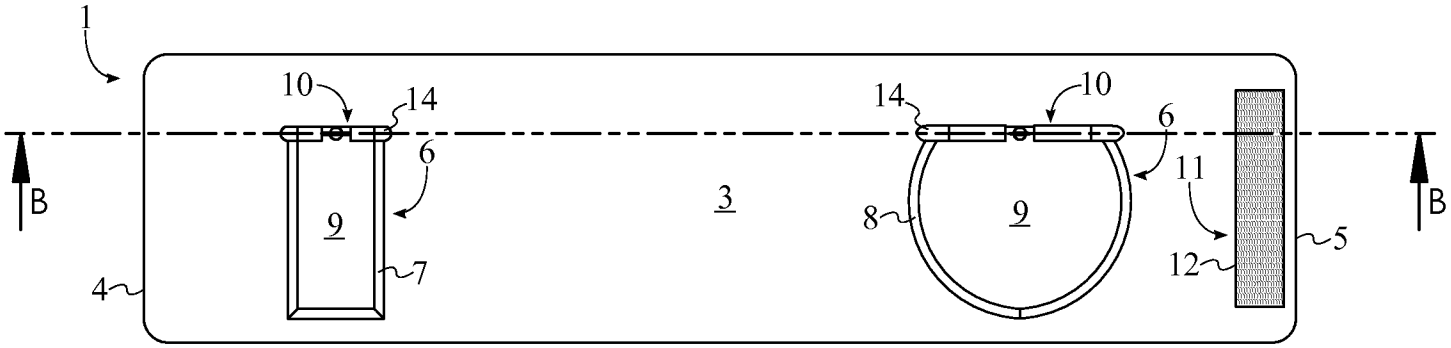
FIG. 6 is a front view of the present invention.
Figure 7:
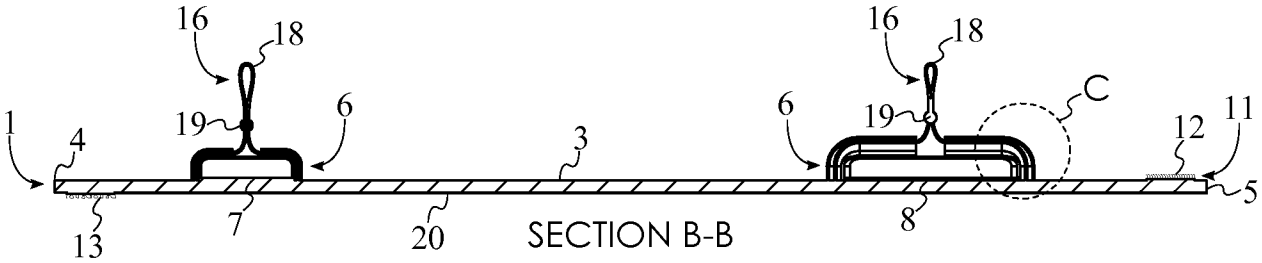
FIG. 7 is a cross-sectional view of the present invention taken along line B-B of FIG. 6.

The present invention further comprises an inner grip layer 20 as shown in FIGS. 2-4. The inner grip layer 20 provides grip for the flexible fabric strap 1 when the flexible fabric strap 1 is wrapped around the smoking pipe, preventing the flexible fabric strap 1 from sliding on the smoking pipe. The inner grip layer 20 is superimposed on the inner surface 2 from the second end 5 to the second interlocking strip 13. This ensures that the inner grip layer 20 is oriented toward the smoking pipe when the flexible fabric strap 1 is wrapped around the smoking pipe. Additionally, this ensures that the majority of the inner surface 2 is able to sufficiently grip the smoking pipe.

Figure 14:
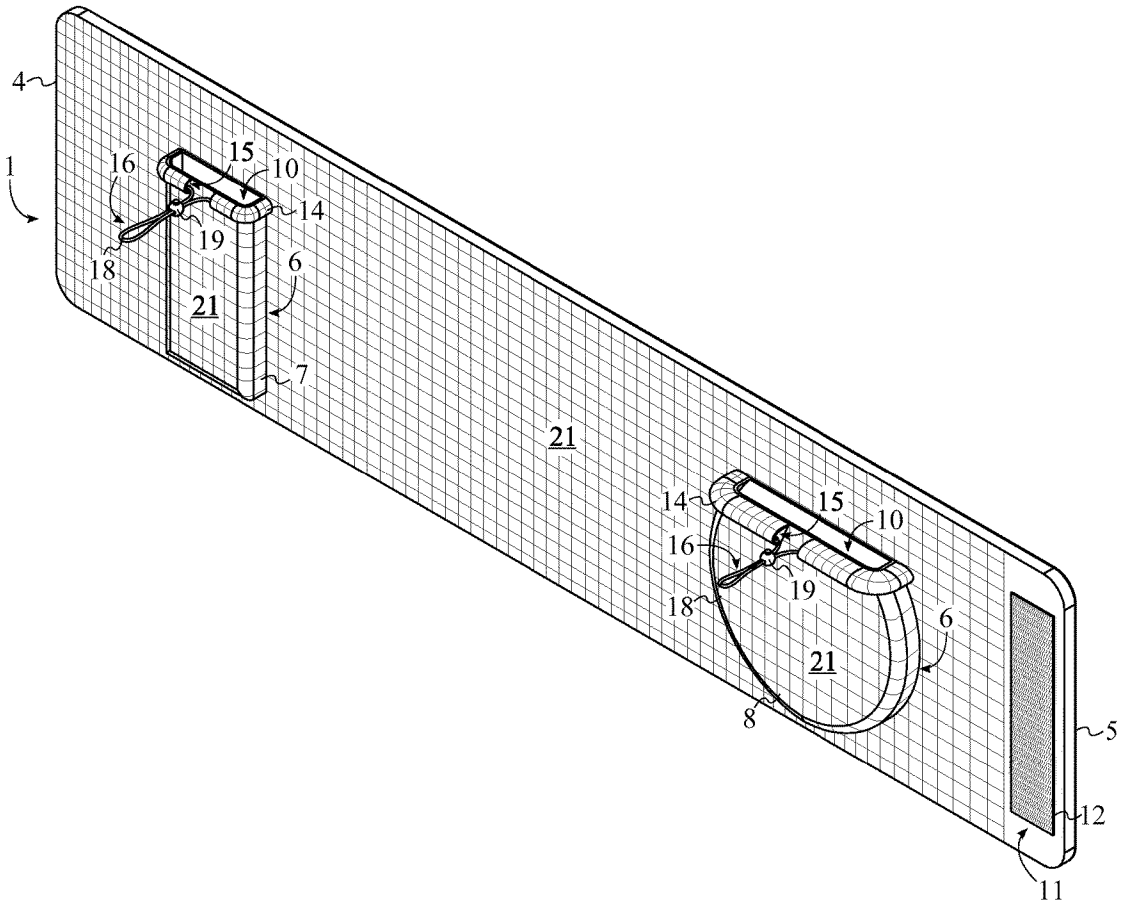
FIG. 14 is a front perspective view of the present invention with a plurality of aesthetic covers.
Figure 15:
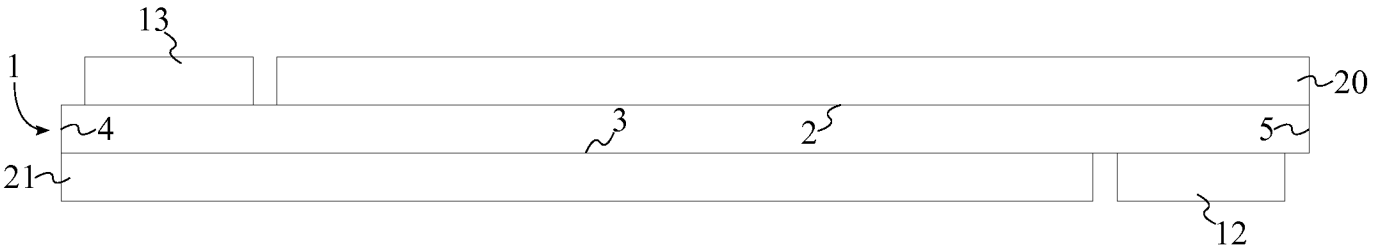
FIG. 15 is a schematic cross-sectional diagram of the present invention.

The present invention further comprises a plurality of aesthetic covers 21 as shown in FIG. 14 and FIG. 15. The plurality of aesthetic covers 21 improves the aesthetic appeal of the present invention and may be customized to the user's preference. The plurality of aesthetic covers 21 is layered upon the outer surface 3 and the at least one accessory pocket 6. As such, the plurality of aesthetic covers 21 is able to provide aesthetic appeal to the portions of the present invention that are visible when the flexible fabric strap 1 is wrapped around the smoking pipe.

Although the present invention has been explained in relation to its preferred embodiment, it is understood that many other possible modifications and variations can be made without departing from the spirit and scope of the present invention as hereinafter claimed.

What is claimed is:

1. A wrapping pouch comprising:

a flexible fabric strap;

at least one accessory pocket;

a hook-and-loop fastener;

at least one cord sheathe;

at least one elastic cord;

at least one cord clamp;

the flexible fabric strap comprising an inner surface, an outer surface, a first end, and a second end;

the hook-and-loop fastener comprising a first interlocking strip and a second interlocking strip;

the first end and the second end being positioned opposite to each other along the flexible fabric strap;

the at least one accessory pocket being connected onto the outer surface;

the first interlocking strip being connected onto the outer surface, adjacent to the second end;

the second interlocking strip being connected onto the inner surface, adjacent to the first end;

the first interlocking strip being removably engaged to the second interlocking strip;

the at least one accessory pocket comprising a lateral portion and an open end;

the at least one cord sheathe being externally connected along the lateral portion, adjacent to the open end;

the at least one cord sheathe comprising a cord opening laterally traversing thereinto;

the at least one elastic cord comprising a tensioning portion and a free portion;

the tensioning portion traversing through the at least one cord sheathe;

the free portion traversing out of the at least one cord sheathe from the cord opening;

the free portion being consisting of a consecutive part; and the at least one cord clamp being slidably engaged along the free portion.

2. The wrapping pouch as claimed in claim 1 comprising:

the first interlocking strip being a hook; and the second interlocking strip being a loop.

3. The wrapping pouch as claimed in claim 1 comprising:

the first interlocking strip being a loop; and the second interlocking strip being a hook.

4. The wrapping pouch as claimed in claim 1 comprising:

the at least one accessory pocket comprising a first accessory pocket and a second accessory pocket;

the first accessory pocket being positioned in between the first interlocking strip and the second interlocking strip, adjacent to the first end; and the second accessory pocket being positioned in between the first accessory pocket and the first interlocking strip.

5. The wrapping pouch as claimed in claim 1 comprising:

an anti-slid layer; and the anti-slid layer being superimposed on the inner surface from the second end to the second interlocking strip.

6. The wrapping pouch as claimed in claim 1 comprising:

a plurality of aesthetic covers; and the plurality of aesthetic covers being layered upon the outer surface and the at least one accessory pocket.

* * * * *